US009073051B2

(12) United States Patent
Schulz et al.

(10) Patent No.: US 9,073,051 B2
(45) Date of Patent: Jul. 7, 2015

(54) HEATING DEVICE FOR CYLINDRICAL LABORATORY VESSELS

(75) Inventors: Jürgen Schulz, Jesteburg (DE); Franz Bucher, Zug (CH); Eiad Kabaha, Bonn (DE)

(73) Assignee: Miltenyi Biotec GmbH (DE)

( * ) Notice: Subject to any disclaimer, the term of this patent is extended or adjusted under 35 U.S.C. 154(b) by 216 days.

(21) Appl. No.: 13/345,443

(22) Filed: Jan. 6, 2012

(65) Prior Publication Data

US 2013/0008884 A1 Jan. 10, 2013

(30) Foreign Application Priority Data

Jan. 24, 2011 (EP) ..... 11151862

(51) Int. Cl.
*H05B 3/00* (2006.01)
*H05B 3/06* (2006.01)
*B01L 7/00* (2006.01)

(52) U.S. Cl.
CPC ..... *B01L 7/00* (2013.01); *B01L 2300/1827* (2013.01)

(58) Field of Classification Search
CPC ..... H05B 3/00; H05B 3/06
USPC ..... 219/520, 521, 432, 433, 385, 386, 535, 219/415; 23/253 PC; 422/65, 547
See application file for complete search history.

(56) References Cited

U.S. PATENT DOCUMENTS 2,031,019 A * 2/1936 Strand et al. ..... 219/385
3,351,801 A * 11/1967 Richter ..... 313/270
3,417,905 A * 12/1968 Aloi ..... 223/74
3,737,627 A * 6/1973 Willard et al. ..... 219/521
4,480,762 A * 11/1984 Thomas ..... 215/273
4,549,923 A * 10/1985 Tachibana et al. ..... 156/423
4,637,520 A * 1/1987 Alvi ..... 215/320
4,787,591 A * 11/1988 Villacorta ..... 248/316.7
5,411,392 A * 5/1995 Von Buren ..... 425/549
5,965,049 A * 10/1999 Carlet ..... 219/505
6,635,492 B2 * 10/2003 Gunter ..... 436/174
7,891,270 B2 * 2/2011 Higashi ..... 74/551.9
2004/0252582 A1 12/2004 Bucher
2006/0013064 A1 1/2006 Bucher
2006/0167487 A1 * 7/2006 Hamada ..... 606/198

(Continued)

FOREIGN PATENT DOCUMENTS

DE 19646114 A1 5/1998
EP 0 826 420 A1 3/1998

(Continued)

OTHER PUBLICATIONS

Translation of Chinese Patent Application CN200520036293 published Apr. 25, 2007 to Wang.*

(Continued)

*Primary Examiner* — Dana Ross
*Assistant Examiner* — Michael Laflame, Jr.
(74) *Attorney, Agent, or Firm* — Morrison & Foerster LLP

(57) ABSTRACT

A heating device for single cylindrical laboratory vessels (e.g., laboratory test tubes), the heating device including a clamp-like element using a force-fit to encompass at least a part of each cylindrical laboratory vessel, one or more electrical resistance heating circuits located at the interior of the clamp-like element, and grab handles to open and close the clamp-like element, thereby to insert or release the cylindrical laboratory vessel from the heating device.

11 Claims, 6 Drawing Sheets

(56) References Cited

U.S. PATENT DOCUMENTS

| | | | | |
|---|---|---|---|---|
| 2007/0248499 | A1 | 10/2007 | Bucher | |
| 2008/0182301 | A1 | 7/2008 | Handique et al. | |
| 2008/0185369 | A1* | 8/2008 | Schmauder et al. | 219/204 |
| 2008/0253223 | A1 | 10/2008 | Bucher | |
| 2009/0162247 | A1* | 6/2009 | Tokieda et al. | 422/65 |
| 2011/0171085 | A1 | 7/2011 | Bucher | |

FOREIGN PATENT DOCUMENTS

| | | | |
|---|---|---|---|
| EP | 0820214 | * | 11/2001 |
| WO | WO-02/066147 | A1 | 8/2002 |
| WO | WO-2004/018105 | A1 | 3/2004 |
| WO | WO-2004/035191 | A1 | 4/2004 |
| WO | WO-2006/076819 | A1 | 7/2006 |
| WO | WO-2006/076820 | A1 | 7/2006 |
| WO | WO-2006/081694 | A1 | 8/2006 |

OTHER PUBLICATIONS

Translation of Chinese Patent Application CN20050036293 to Wang published Apr. 25, 2007.*

European Search Report and Search Opinion mailed on Jul. 6, 2011, for European Patent Application No. 11151862.7, filed on Jan. 24, 2011, six pages.

European Search Report and Search Opinion mailed on May 30, 2012, for European Patent Application No. 12152033.2, filed on Jan. 23, 2012, four pages.

* cited by examiner

HEATING DEVICE FOR CYLINDRICAL LABORATORY VESSELS

CROSS-REFERENCE TO RELATED APPLICATIONS

This application claims priority to European Application No. EP11151862.7, filed Jan. 24, 2011 the content of which is incorporated herein by reference in its entirety.

FIELD OF THE INVENTION

This invention is directed to a heating device for cylindrical laboratory vessels, especially vessels such as laboratory tubes having a screw cap, of the type commonly used in biological research.

BACKGROUND

Many processes in biological or medical research such as enzymatic catalyzed reactions or cell culture require ambient temperatures between 25 and 45° C. Higher temperatures of up to 70° C. are needed to denaturate proteins or kill pathogenic organisms. Since nearly all biological processes are performed in this temperature range, heating devices for laboratory vessels are commonly used in biological laboratories and are available for many different applications or vessels.

For biological research, the most common laboratory vessel is a so called "tube", i.e. tube-shaped, cylindrical vessels as shown in FIG. 1 with a screw cap 20, mostly made from polymers such as polyethylene or polypropylene. Such tubes have usually a capacity of 1 to 200 ml and can be heated up to autoclave temperature (about 130° C.) for sterilizing or cooled as low as −70° C. for storage purposes. Tubes are disposable and can be obtained from several companies.

Heating devices for biological research, especially for tubes, are commercially available and comprise often a rack having a plurality of openings for tubes and a heating or warming dry block. The temperature is usually maintained by electrical resistance heating and can be controlled very precisely in order to perform temperature-dependent reactions.

For example, German patent publication DE 19646114 A1 discloses a laboratory thermostat with heating blocks and a holder for a plurality of tubes. Patent Publications WO 2004/018105 and US 2008/0182301 describe heating devices for a plurality of samples, wherein the tubes are located in a sample block which is pressed on the heating block with a clamp-like lid to ensure good transfer of heat between the samples, the sample block and the heating block.

Heating devices with heating blocks are capable of heating many tubes at the same time to the same temperature. However, sometimes there is a need for processing an individual sample or a limited number of samples, but at different temperatures.

A heating device for a single laboratory vessel is disclosed in US 2006013064 A1. Here, heating a mixing device for a laboratory vessel with a heat conducting drive axle is described. However, this heating device requires a special mixing vessel and cannot be used for the commonly used tubes since the heat is applied through the drive axle of the mixer.

U.S. Pat. No. 3,737,627 describes an electric test tube heater wherein individual laboratory tubes can be heated. The laboratory tube is inserted in the heating circuit and fixed with a clamp. Since the tube is only inserted into the heating circuit (with some play) and the heating circuit is separate from the clamp, the tube is not well encompassed by the heating circuit, resulting in poor regulated transfer of heat.

In the heating device according to European Patent EP 0826420, the laboratory tube is fixed in a bushing with an integrated heating circuit with a screw. Inserting and removing a laboratory tube from such a device is laborious and requires a screw driver.

Accordingly, there is a need for a heating device, suitable for the heating of laboratory vessels to temperatures common in biological research. The heating device should be easy and safe to handle, space saving and compatible with other lab equipment.

SUMMARY

This disclosure is directed to a heating device for a single, i.e. individual, cylindrical laboratory vessel, including a clamp-like element to encompass by a force-fit at least a part of the cylindrical laboratory vessel, one or more electrical resistance heating circuits located at the interior of the clamp-like element, and grab handles to open and close the clamp-like element for inserting or releasing the cylindrical laboratory vessel from the heating device.

DETAILED DESCRIPTION

Figure 1:
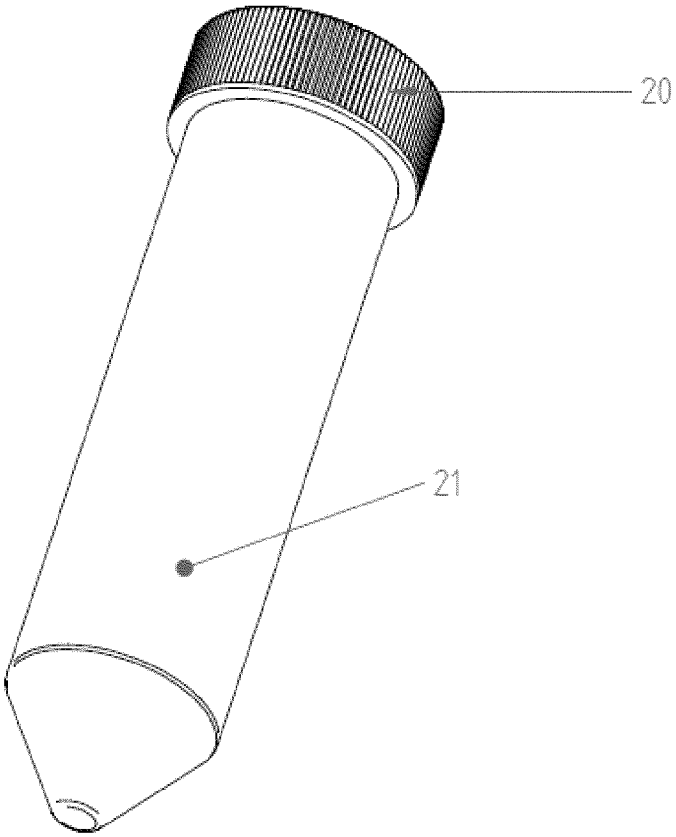
FIG. 1 and FIG. 6 show a tube or mixing vessel of the type to be heated by the present heating device.
Figure 6:
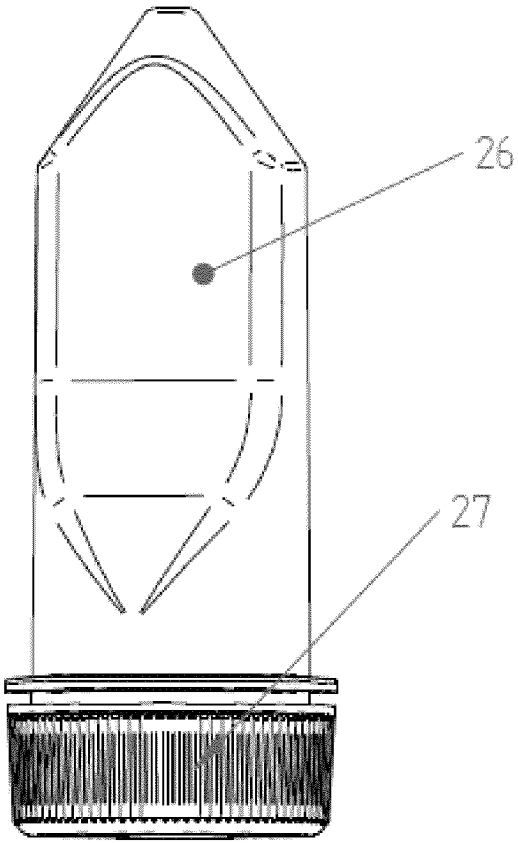

A device in accordance with the invention is especially suited for the heating of cylindrical laboratory vessels of the type commonly used in biological and other research. Such cylindrical laboratory vessels are for example tube-like containers as shown in FIG. 1 or 6, optionally with a screw cap or a flip-top (hereinafter called "tubes"). Tubes suitable for the device can be made from glass or polymers such as polyethylene or polypropylene and have a typical capacity of 1 to 200 ml with a typical diameter of 10 to 50 mm Polymer tubes are usually single-use and can be obtained from several companies like Eppendorf, BD (under the trade name FALCON), Baxter or Abbott.

The heating device according to the invention includes a clamp-like element (mechanism) to encompass at least a part of the cylindrical laboratory vessel in a force-fit manner. The clamp-like element preferably is shaped like a tube or may ring spring clamp the cylindrical laboratory vessel.

This clamp-like element may be provided by one or more lengthwise slots or openings defined in the body of the heating device and include two or more grab handles for opening the device. The device closes by the resilient force of the clamp-like mechanism. The device thereby does not require a screw or similar means to mechanically close or compress the clamp-like element in order to fix or secure the laboratory tube.

Figure 2:
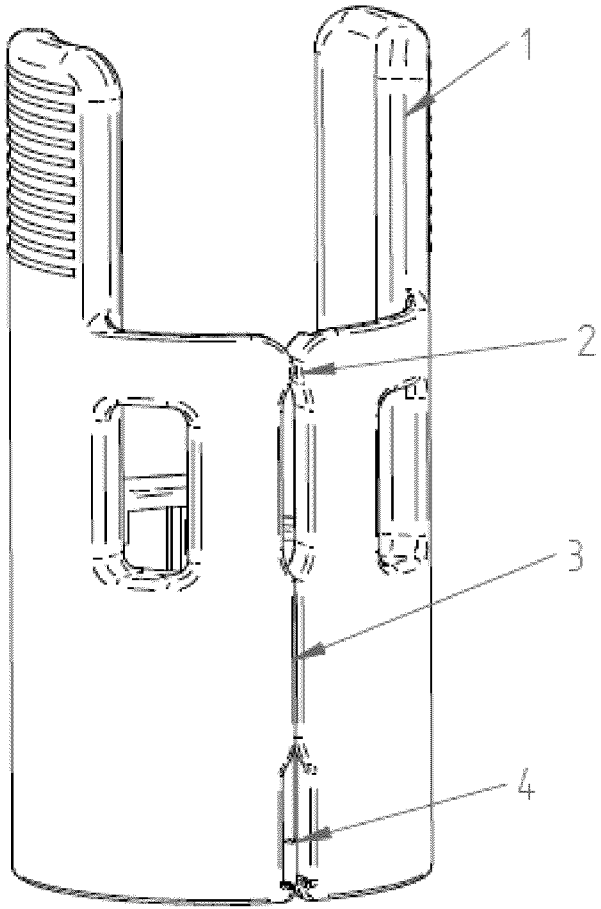
FIG. 2 and FIG. 5 are respectively side and bottom views of the present heating device.

FIG. 2 shows an embodiment of the invention with two grab handles 1 on top of the clamp-like element of the device and one lengthwise opening 3 defined in the body of the clamp-like element. By pressing the two grab handles 1 against each other, the clamp-like element opens at the bottom 4 and the vessel is inserted or released from the device.

For opening or closing of the clamp-like element, one or more slip-free bearings are provided at the opposite sides of the opening of the clamp-like element. FIG. 2 shows slip-free bearings 2. The device and/or the clamp-like element can be opened for inserting or releasing the cylindrical laboratory vessel by the grab handles 1 which are at the outermost portion of the device (as seen from the vessel opening) to ensure good leverage for easy opening of the clamp-like element.

Figure 3:
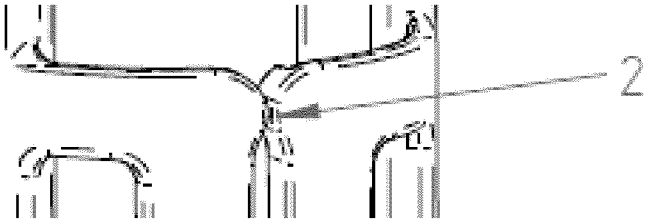
FIG. 3 is an enlarged view of a slip-free bearing.

The slip-free bearings of the clamp-like mechanism allow a twist-free opening of the device. Slip-free bearings are well known in the field and may be, for example, a cam on one side of the opening fitting into a groove on the other side of the opening. By way of example, FIG. 3 shows an enlarged view of exemplary slip-free bearing 2.

A heating device according to the invention may define one or more slots or openings and include one or more slip-free bearings for opening or closing of the clamp-like element.

For the heating of a cylindrical laboratory vessel having a portion with a small diameter and another portion with a larger diameter, for example a tube or the mixing vessels described below with a screw cap, the clamp-like element is provided with an internal shape to accommodate at least part of such a laboratory tube. To provide the internal shape, the heating device may include a clamp-like opening with a cylindrical groove for take-up of the part of the vessel with the large diameter such as a screw cap. This embodiment allows the heating device to be placed upright or standalone on a working table. Optionally, the heating device includes an enlarged bottom part or pedestal for stable standing.

Figure 4:
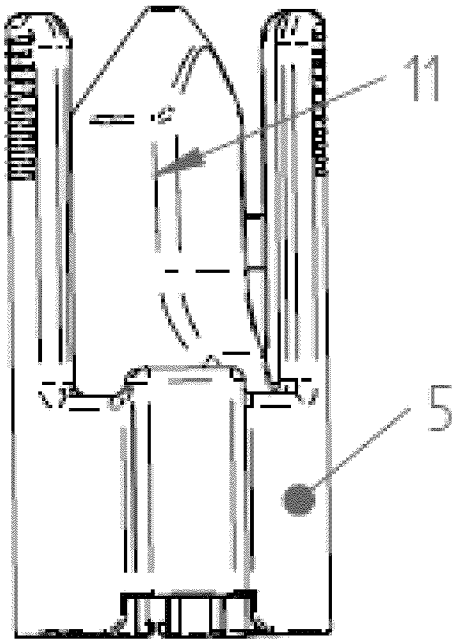
FIG. 4 shows the present heating device with an inserted screw-cap tube.
Figure 5:
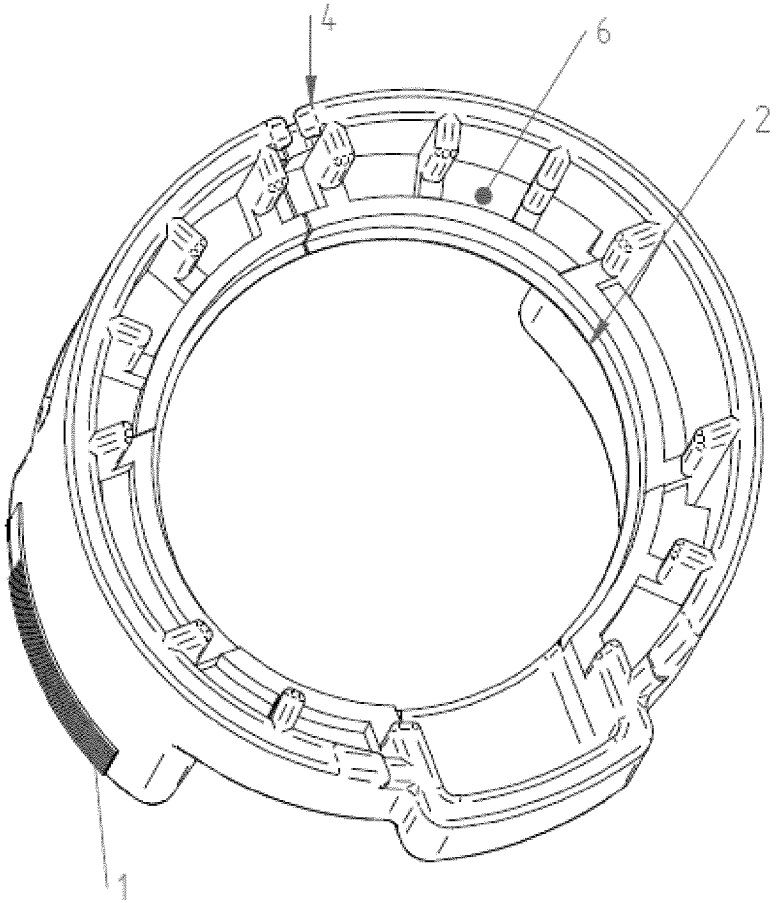

FIG. 4 shows a device 5 in accordance with the invention with an inserted screw-cap tube 11. Device 5 at the tube opening defines a groove with an internal diameter fitting the screw cap and the tube at the position of the heating circuit. FIG. 5 shows a bottom view of device 5. This shows the grab handles 1, the heating zone or circuit 2 and the groove 6 at the opening of the clamp-like element with an enlarged diameter compared to the diameter at the position of heating circuit 2 to accommodate, for example, the screw cap of a tube. The clamp-like element is slotted at the position of the snap-fit mechanism 4.

In another embodiment, the heating device includes a clamp-like element having an internal shape to accommodate at least part of a fractionating or dissociating vessel of the type disclosed in patent publications WO 2006076819 A1, WO 2004035191 A1, WO 2002066147 A1, WO 2006081694 A1 or WO 2006076820 A1, the disclosures of which are incorporated herein by reference. Such fractionating or dissociating devices or vessels have the same or a similar shape as the above-mentioned tubes. FIG. 6 shows an example of a fractionating or dissociating device or vessel with cap 27 comprising the mixing device and having a tube-shaped vessel 26.

The electrical resistance heating circuits are located at the interior of the clamp-like element adjacent to the cylindrical laboratory vessel when inserted into the present heating device. The heating circuit and/or the clamp-like element encompass at least a part of the cylindrical laboratory vessel in a force-fit manner. The necessary pressure for the force-fit is provided by the clamp-like element of the device. Due to the clamp-like element, the vessel is pressed or fitted against the heating circuit thereby ensuring good transfer of heat from the heating circuit to the vessel. Preferably, the heating device encompasses the cylindrical laboratory vessel in a force-fit manner only at the location or at the surface of the electrical resistance heating circuits.

A heating device according to the invention may include one or more electrical resistance heating circuits, depending on the shape and mechanism of the clamp-like element's opening. The electrical resistance heating circuits may have the form of a ring according to the shape of the vessel to be heated. The electrical resistance heating circuit may be slotted to support the clamp-like element of the heating device.

The electrical energy for the resistance heating circuits is provided through appropriate connectors from an external power source. Resistance heating circuits are well known in the field, and may be printed or applied in form of heating/resistance wires. Suitable wire materials are for example nickel or nickel/copper alloy. Since the present device is primarily intended for use in biological laboratories, the heating circuits are suitable to heat the inserted vessel and its contents to temperatures between 15 C.° and 90°, especially to temperatures between 25 and 45° C.

Figure 7:
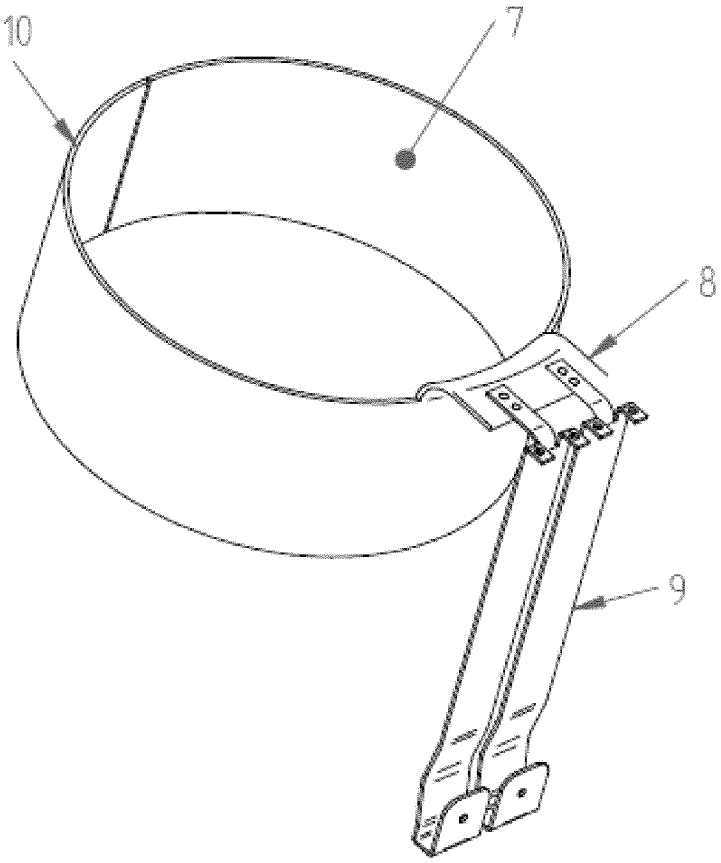
FIG. 7 shows a ring-shaped heating circuit.

FIG. 7 shows a heating circuit in form of a ring-shaped film 7, with electric contacts 8. The heating circuit is slotted at position 10 to allow the clamp-like element of the heating device to open the body of the device together with the heating circuit. The contact tabs 9 are used for connecting the heating circuit to the external power supply.

Especially suitable resistance heating circuits have a temperature-dependent electrical resistance, which can be utilized to control the temperature of the cylindrical laboratory vessel by controlling the power supply (i.e. the voltage) of the heating circuit. In one embodiment, the heating device is connected to a control system, which can be used to set the temperature of the vessel via the electrical resistance of the heating circuit. The desired temperature of the vessel is set by the user via the control system, which calculates the corresponding resistance. By raising the temperature of the vessel, the resistance of the heating circuit is raised and when the desired temperature (equal to a certain electrical resistance) is reached, the power supply to the heating circuit is reduced or stopped. The control system may provide software for complex temperature programs, for example including several heating and cooling periods.

The electrical resistance heating circuits may be applied to the inner wall of the device with the aid of an adhesive or by printing. Heating/resistance wires may also be embedded into the device or the clamp-like element during manufacturing. Furthermore, the heating resistance circuit may be protected from the vessel by a suitable cover film or a coating.

In another embodiment, the electrical resistance heating circuits are exchangeable, i.e. can be released from and inserted back into the clamp-like element or the device. For instance, exchangeable electrical resistance heating circuits are located on a support which may be manufactured as one piece with the electrical connector. The electrical resistance heating circuits may be applied with adhesive or be printed on the support or embedded into the support. Supported heating resistance circuits may be protected from the vessel by a suitable cover film or a coating.

Figure 8:
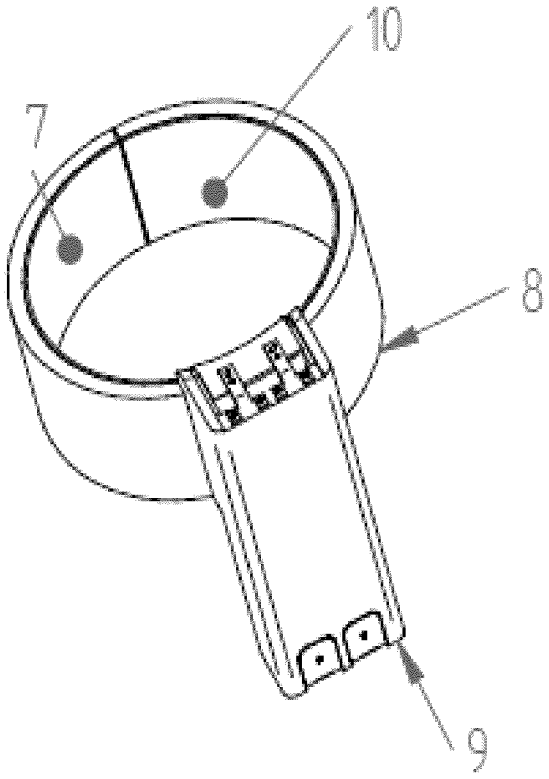
FIG. 8 shows a ring-shaped heating circuit on a support insertable into the present heating device.

FIG. 8 shows a heating circuit 7 on a support 8. Electrical power is supplied via connectors 9. In order to open the clamp-like element, both the support and the heating circuit are slotted. The heating resistance wires are protected by the cover film or coating 10.

In one embodiment, the heating device includes a clamp-like element defining a slot or opening in the device, an electrical resistance heating circuit and a slip-free bearing.

The supported electrical resistance heating circuit can be inserted into the heating device in an appropriate recess of the body of the heating device to provide a snap-in mechanism. The recess and the support may be shaped to enable the insertion of more than one electrical resistance heating circuit, which is useful for example for heating larger volumes or to provide additional heating power for higher temperatures. Furthermore, the recess and the support may be shaped to enable the insertion of electrical resistance heating circuits into different positions in the device, for example depending on the shape or the extent of filling of the vessel.

Figure 10:
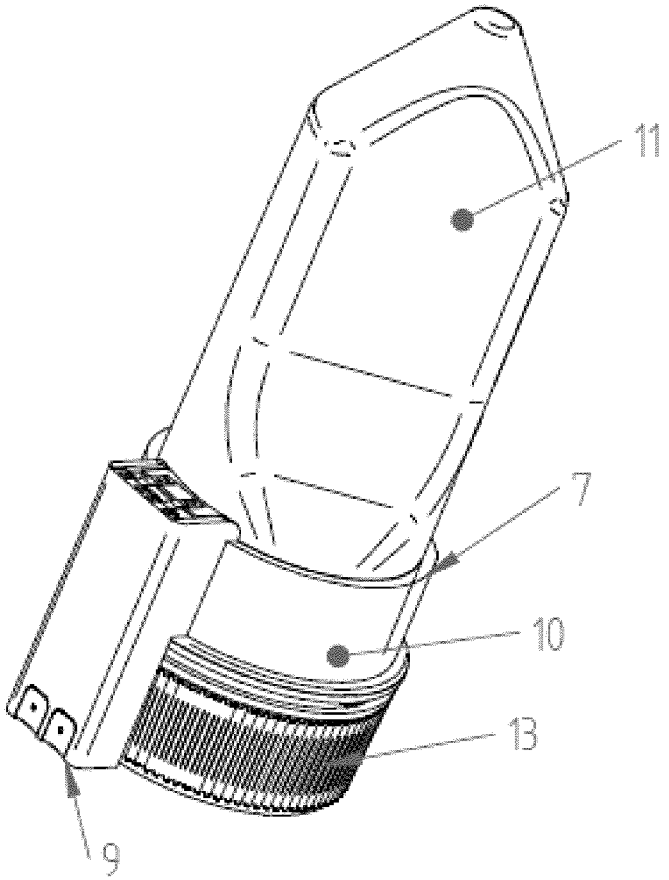
FIG. 10 shows a tube or mixing vessel inserted into a supported heating circuit (where the body of the heating device is omitted).
Figure 9:
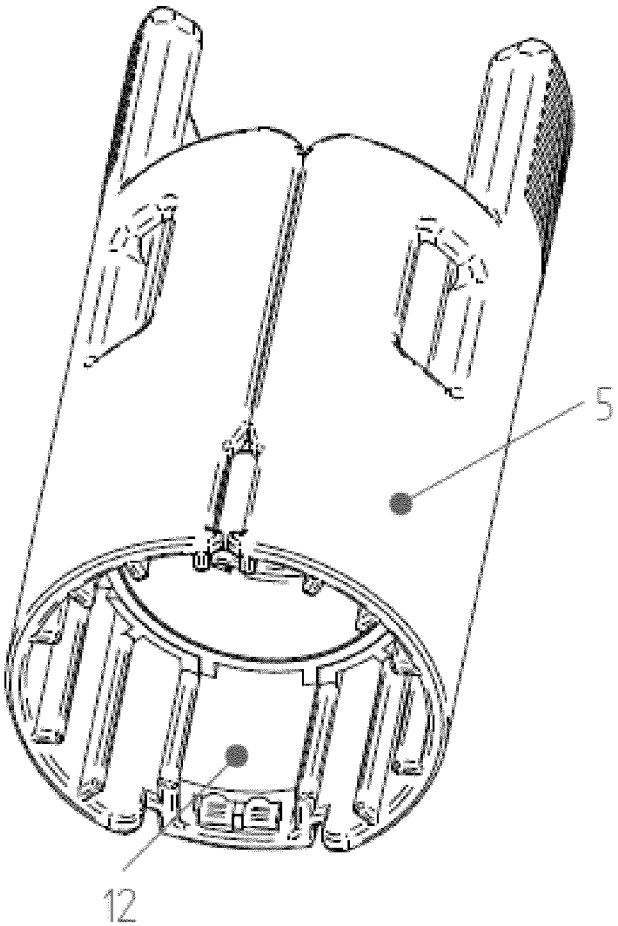
FIG. 9 shows the present heating device with an inserted supported heating circuit.

For example, FIG. 9 shows a device with a clamp-like element with an inserted supported heating circuit with a recess fitting to the electrical connector 12 of the supported heating circuit of FIG. 8, thereby providing a snap-in mechanism to fasten the supported heating circuit in the device. FIG. 10 shows a tube or mixing vessel 11 with a screw cap 13 inserted into a supported heating circuit 10 having connectors 9, with the body of the heating device omitted from the drawing.

In one embodiment, the body of the heating device and/or the clamp-like element defines a recess to accommodate a supported heating circuit, wherein the recess provides thermal insulation. The insulation may be provided by air through division bars between the outer wall of the body of the device and the heating circuit. Such air insulation is shown as groove 6 of FIG. 5 and also in FIG. 9.

Figure 11:
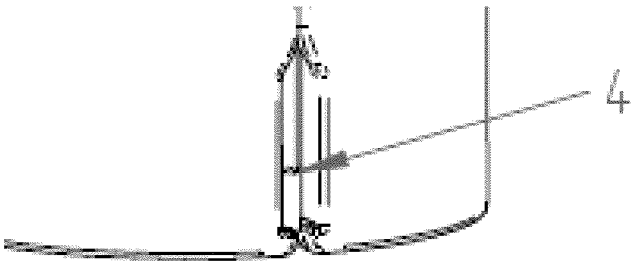
FIG. 11 is an enlarged view of the present snapping mechanism.

Depending on the shape or number of the cylindrical laboratory vessels to be heated, it is advantageous to attach the heating device to a support such as a rack. For this embodiment, the heating device includes one or more form fit snapping mechanisms to connect the heating device to the support. By way of example, FIG. 3 shows one embodiment of such a form fit snapping mechanism 4. FIG. 11 provides an enlarged view of the snapping mechanism 4. Of course, the support has a corresponding counterpart to the snapping mechanism of the heating device.

Figure 12:
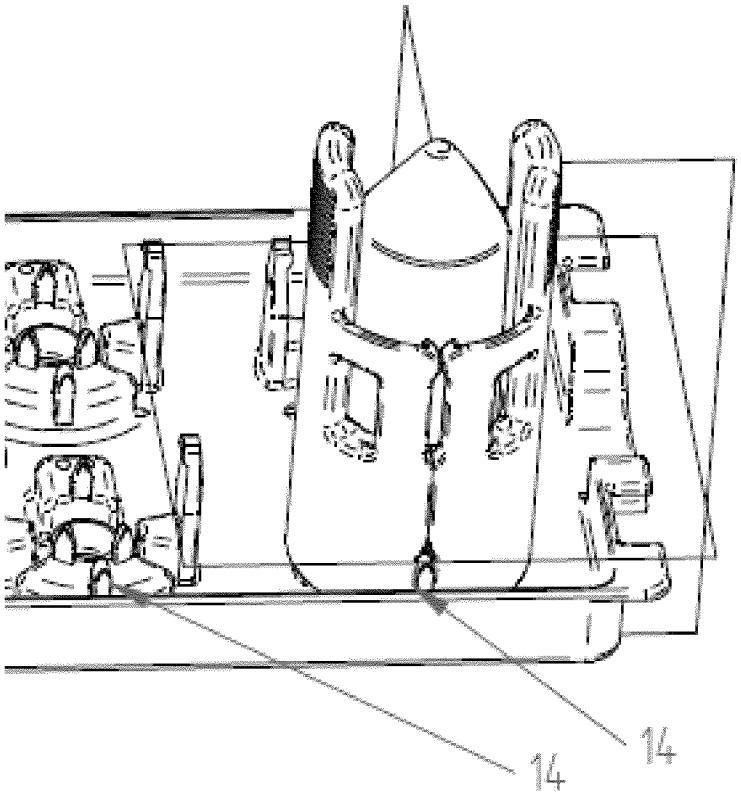
FIG. 12 shows a rack with a plurality of positions for the present heating device.

The support for the present device may include 1 to 20, preferably 1 to 8, especially 1 to 4, openings to receive and support the equivalent number of vessels or tubes. Advantageously, the support may include the power source to supply the resistance heating circuits of the heating devices by connectors fitting into the connectors of the heating circuits. The temperature of each of the tube heating positions can be adjusted separately. For better illustration, FIG. 12 shows such a rack-like support with a plurality of tube heating positions. The counterpart 14 to the snapping mechanism of the device 4 (see FIG. 3) is shown. The left tube position of the support is empty, whereas the right position has a heating device with an inserted tube in place.

Further, the support may include a control system to adjust the power supply of each heating circuit for a temperature and processing time as defined by the user.

It is another goal to provide a processing system allowing the fractionating or dissociating of cells or cell fragments originating from animal or human tissue or plants during or followed by enhanced temperature. For this embodiment, the cylindrical laboratory vessel used with the invention may have the shape and functionality of the fractionating or dissociating vessels disclosed in the above mentioned patent publications WO 2006076819 A1, WO 2004035191 A1, WO 2002066147 A1, WO 2006081694 A1 or WO 2006076820 A1. The otherwise conventional device to operate the fractionating or dissociating vessels can be used as a rack for the present heating device for this embodiment, including a power supply and control system. The heating device in this embodiment has an internal shape that accommodates at least a part of each such mixing device/vessel and includes one or more form fit snapping mechanisms to connect the device to the support. FIG. 6 shows the shape of a mixing vessel as disclosed in the above mentioned patent publications.

The heating device and the support for the heating circuit may be made from any material having sufficient thermal strength with regard to the temperature of the resistance heating circuits, and sufficient mechanical strength to support the clamp-like elements. Suitable materials are stainless steel or thermoplastic polymers such a polypropylene or polyamide. The use of thermoplastic polymer is advantageous since then the device can be manufactured by injection molding.

This disclosure is illustrative and not limiting. Further modifications and improvements will be apparent to those skilled in the art in light of this disclosure, and are intended to fall within the scope of the appended claims.

What is claimed is:

1. A heating device for an individual cylindrical laboratory vessel, comprising:

a clamp configured to hold by a resilient force at least a part of a cylindrical laboratory vessel, the clamp defining at least one slot or elongated opening having a length axis lying parallel to a length axis of the vessel;

at least one electrical resistance heating circuit located at the interior of the clamp; and grab handles configured to open and close the at least one slot or elongated opening of the clamp for inserting or releasing the cylindrical laboratory vessel from the heating device, the grab handles extending from the clamp, wherein each grab handle comprises a length axis in a direction parallel to that of the length axis of the vessel, and wherein the clamp is configured to extend circumferentially around the vessel when the clamp is closed.

2. A heating device according to claim 1, wherein an interior of the clamp conforms to a shape of the cylindrical laboratory vessel.

3. A heating device according to claim 1, wherein the clamp comprises a cam fitting into a groove.

4. A heating device according to claim 1, wherein the electrical resistance heating circuit is on an inner wall of the clamp.

5. A heating device according to claim 1, wherein the electrical resistance heating circuit is embedded into the clamp.

6. A heating device according to claim 1, wherein the electrical resistance heating circuit is exchangeable.

7. A heating device according to claim 1, wherein the electrical resistance heating circuit is on a support insertable into the clamp.

8. A heating device according to claim 1, wherein the clamp defines an interior configured to accommodate at least part of a cylindrical laboratory vessel having a screw cap or a flip-top.

9. A heating device according to claim 8, wherein an opening of the clamp defines a cylindrical groove for take-up of the screw cap or the flip-top.

10. A heating device according to claim 1, further comprising a control system which determines a temperature of the cylindrical laboratory vessel from the electrical resistance of the electrical resistance heating circuit.

11. A heating device according to claim 1, further comprising at least one form fit snapping mechanism adapted to connect the clamp to a support.

* * * * *